US007115845B2

(12) United States Patent
Nomura et al.

(10) Patent No.: US 7,115,845 B2
(45) Date of Patent: Oct. 3, 2006

(54) SUPERHEATED STEAM GENERATOR

(75) Inventors: Masami Nomura, 14-15, 1-chome Kashidanishi, Higashiosaka-shi Osaka (JP) 577-0835; Masaaki Nomura, Higashiosaka (JP); Yuzuru Marukuni, Kyoto (JP)

(73) Assignees: Masami Nomura, Osaka (JP); Masaki Nomura, Osaka (JP); Takashi Nomura, Osaka (JP)

( * ) Notice: Subject to any disclaimer, the term of this patent is extended or adjusted under 35 U.S.C. 154(b) by 404 days.

(21) Appl. No.: 10/405,086

(22) Filed: Apr. 2, 2003

(65) Prior Publication Data

US 2003/0215226 A1 Nov. 20, 2003

(30) Foreign Application Priority Data

Apr. 2, 2002 (JP) ..... 2002-100174
Aug. 5, 2002 (JP) ..... 2002-227007

(51) Int. Cl.
*H05B 1/00* (2006.01)
*H01F 17/04* (2006.01)

(52) U.S. Cl. ..... 219/630; 336/221

(58) Field of Classification Search ..... 219/630, 219/631, 670, 677, 628, 629; 336/221–234; H01F 17/04
See application file for complete search history.

(56) References Cited

U.S. PATENT DOCUMENTS 3,936,625 A * 2/1976 Burnett ..... 219/630
4,341,936 A 7/1982 Virgin
4,829,911 A * 5/1989 Nielson ..... 110/234
5,645,693 A * 7/1997 Gode ..... 202/173
5,914,065 A * 6/1999 Alavi ..... 219/631
5,990,465 A 11/1999 Nakaoka et al.
6,008,482 A 12/1999 Takahashi et al.
6,144,020 A * 11/2000 Usui et al. ..... 219/631
6,485,228 B1 * 11/2002 Komatsu ..... 405/52
6,762,396 B1 * 7/2004 Abbott et al. ..... 219/543

FOREIGN PATENT DOCUMENTS

| | | |
|---|---|---|
| EP | 0 579 073 A1 | 1/1994 |
| JP | 59-170641 | 9/1984 |
| JP | 62-58590 | 3/1987 |
| JP | 03098286 | 4/1991 |
| JP | 08135903 | 5/1996 |
| JP | 09-303702 | 11/1997 |
| JP | 2889607 | 2/1999 |
| JP | 2000065312 | 3/2000 |

* cited by examiner

*Primary Examiner*—Daniel Robinson
(74) *Attorney, Agent, or Firm*—Nixon & Vanderhye, PC

(57) ABSTRACT

A superheated steam generator of an electromagnetic induction type includes: a conduit, which provides a passageway of generated steam; a superheating tank, which is part of the conduit midway through the conduit; and a coil, which is disposed around the superheating tank and is connected to a high-frequency AC power supply, the superheated steam generator further including a magnetic body, disposed inside the superheating tank, which is in contact with the steam in the passage of the steam. According to this construction, superheated steam can be produced more efficiently. In addition, the temperature inside the tank can be increased and decreased more gradually.

25 Claims, 5 Drawing Sheets

SUPERHEATED STEAM GENERATOR

FIELD OF THE INVENTION

The present invention relates to a superheated steam generator of an electromagnetic induction type, in which a coil connected to an AC power supply is disposed around a superheating tank midway through a conduit for providing a passageway of steam.

BACKGROUND OF THE INVENTION

One example of a superheated steam generator of an electromagnetic induction type is disclosed in Japanese Publication for Unexamined Patent Application No. 303702/1997 (Tokukaihei 9-303702; published on Nov. 28, 1997), in which generated steam is superheated to obtain superheated steam of about 500° C.

In this superheated steam generator, a ceramic insulator is provided around a copper tank through which generated steam passes, and a coil connected to a high-frequency AC power supply is disposed around the ceramic insulator, the coil being part of coolant circulating piping.

Energizing the coil creates magnetic field lines through the tank, which generates eddy currents through the tank and produces Joule heat therein. The steam is superheated as it passes through the tank, thus producing superheated steam that far exceeds 100° C. in temperature.

The superheated steam so produced by the superheated steam generator requires different temperature settings for different uses, which may be food processing such as thawing, baking, boiling, and deoiling, or other areas of applications such as disinfections and drying.

One drawback of the superheated steam generator of the foregoing publication is that the Joule heat produced by the magnetic field lines brings an abrupt increase of temperature in the tank. It is therefore extremely difficult to control the temperature only by turning on or off the power supply. This drawback has limited the applicable areas of the superheated steam generator.

Further, while the foregoing superheated steam generator is capable of generating high temperature steam, the efficiency of superheating the steam is poor. It was therefore difficult to produce a sufficient amount of steam for various uses, including heating and disinfecting of food products.

SUMMARY OF THE INVENTION

An object of the present invention is to provide a superheated steam generator of an electromagnetic induction type, in which a coil connected to a high-frequency AC power supply is disposed around a superheating tank midway through a conduit for providing a passageway of steam, so that the temperature inside the tank can be controlled to gradually increase or decrease so as to efficiently produce superheated steam.

As the term is used herein, the "high-frequency" of the high-frequency AC power supply is meant to indicate a frequency higher than the frequency range of 50 Hz to 60 Hz used for home power supply.

In order to achieve the foregoing object, a superheated steam generator according to the present invention includes: a conduit, which provides a passageway of externally supplied steam to a steam discharge port; a superheating tank, which is part of the conduit midway through the conduit; and a coil, which is disposed around the superheating tank and is connected to a high-frequency AC power supply, the steam in the superheating tank being superheated by Joule heat that is produced by electromagnetic induction by applying a voltage to the coil, the superheated steam generator further including: a magnetic body, disposed inside the superheating tank, which is in contact with the steam in the passage of the steam.

The magnetic body disposed in the conduit through which the steam passes exerts magnetism on the magnetic field lines that are generated by applying a voltage from the high-frequency AC power supply. This reduces the magnitude of eddy currents by a small amount. The eddy currents produce Joule heat that causes the temperature inside the tank to rise. Thus, by reducing the eddy currents, the temperature inside the tank increases more gradually than conventionally. This enables temperature control to be carried out more accurately, as compared with conventional superheated steam generators that accompany an abrupt temperature increase of the steam.

Further, the superheated steam generator of the present invention superheats the steam not only by the Joule heat that is produced by the eddy currents in the tank but also by bringing the steam in contact with the magnetic body that has been heated by the Joule heat. As a result, superheated steam can be generated more efficiently than conventionally, enabling a sufficient amount of high temperature and high pressure steam of not less than 300° C. to be continuously produced for various uses, including disinfections of food products.

For a fuller understanding of the nature and advantages of the invention, reference should be made to the ensuing detailed description taken in conjunction with the accompanying drawings.

DESCRIPTION OF THE EMBODIMENTS

[First Embodiment]

Figure 1:
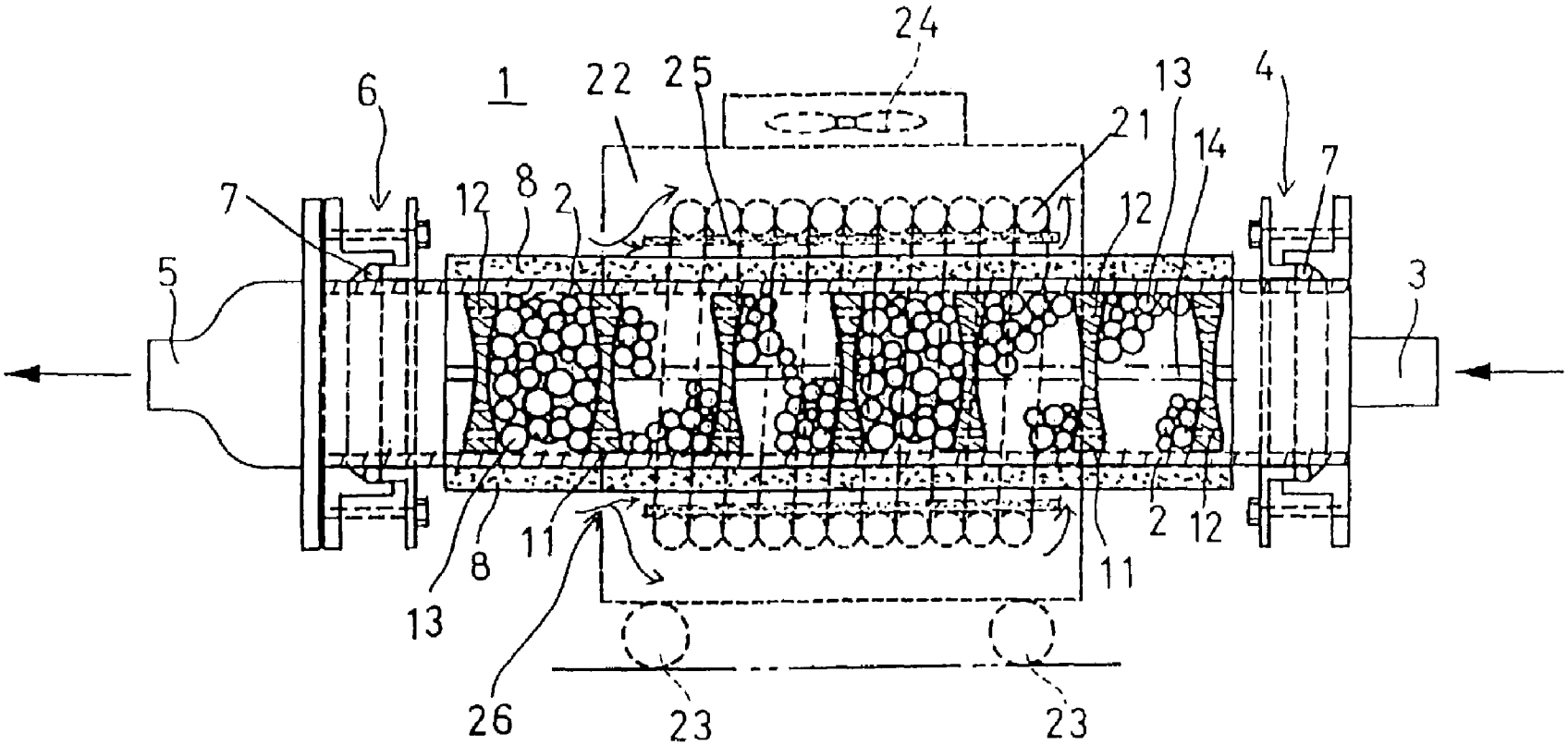
FIG. 1 is a cross sectional view showing a relevant part of a superheated steam generator according to one embodiment of the present invention.
Figure 2:
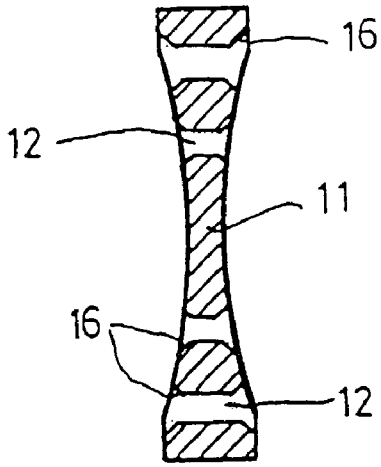
FIG. 2 is a cross sectional view showing a magnetic plate of FIG. 1.

Referring to FIG. 1 and FIG. 2, the following describes one embodiment of a superheated steam generator according to the present invention.

As shown in FIG. 1, the superheated steam generator of the present embodiment includes a tank 1, a steam supply pipe 3, and a superheated steam discharge pipe 5, the tank 1 being a passageway of supplied steam from the steam supply pipe 3 to the superheated steam discharge pipe 5. Other components of the superheated steam generator include metal plates (magnetic plates) 11 and magnetic beads 13, both of which are provided inside the tank 1, and a high-frequency coil 21 that is disposed around the tank 1.

The tank 1 is in communication with a steam generator (not shown) that generates steam. The steam flows in the direction of arrow shown in FIG. 1.

In the present embodiment, the tank 1 includes a casing 2 made of ceramic, which is connected to the steam supply pipe 3 on one end and the superheated steam discharge pipe 5 on the other end. The steam supply pipe 3 and the superheated steam discharge pipe 5 are connected to the casing 2 via heat resistant gaskets 7 and fixed thereon with flanges 4 and 6, respectively.

The casing 2 of the tank 1 is compact in size, with an outer diameter of 120 mm and a length of 250 mm.

The tip of the superheated steam discharge pipe 5 is connected to a food processor (not shown), which is formed in one piece with the superheated steam generator, so as to heat food products as they are transported on a belt conveyer or the like, without decreasing the temperature of the steam. Note that, the heat resistant gasket 7 that is fastened in the vicinity of the superheated steam discharge pipe 5 may be made of a material such as heat resistant rubber or metal.

Inside the tank 1, the metal plates 11 are disposed with intervals. The metal plates 11 are made of stainless steel 403, 430, have concave faces, and are fixed in position by a shaft 14 that is concentric to the central axis of the metal plates 11 inside the tank 1. Further, the metal plates 11 have a plurality of orifices 12. Between the metal plates 11 are disposed a plurality of beads 13 that are made of the same kind of metal as the metal plates 11. The metal plates 11 are fixed on the shaft 14 with the beads 13 in between. That is, the orifices 12 of the metal plates 11 and the spacing between the beads 13 provide passageways for the steam inside the tank 1.

Note that, in the superheated steam generator of the present embodiment, the metal plates 11, the beads 13, and the shaft 14 are all made of metal, while ceramic is used for the casing 2. However, the present invention is not just limited to this implementation. For example, the casing 2, the metal plates 11, the beads 13, and the shaft 14 may be all made of metal, as in the Second and Third Embodiments to be described later.

When using a metal casing, it is preferable to form the metal plates 11 and the casing 2 in one piece, by joining the two by welding, for example. This enables both the casing 2 and the metal plates 11 to be heated by induction heating, thereby improving heat efficiency of the superheated steam generator.

Further, in the superheated steam generator of the present embodiment, the orifices 12 of the metal plates 11 are formed such that their opening ends 16 are tapered, as shown in FIG. 2. The beads 13 filling the tank 1 have different diameters.

The tapered opening ends 16 and different diameters of the beads 13 provide a balance between an area of contact with the steam and an area of spacing provided for the passage of the steam.

On the outer side of the casing 2 is provided a heat-insulating wall 8 made of ceramic, and around the heat insulating wall 8 is a cart 22. Using wheels 23, the cart 22 can move back and forth along the outer wall of the casing 2 of the tank 1. On the inner side of the cart 22 is disposed a casing 25 made of ceramic, the casing 25 being spaced from the heat insulating wall 8. Around the casing 25 is a coil 21, which is fixed on the casing 25 and connected to an AC power supply.

According to this configuration, supplying power from the high-frequency AC power supply causes the coil 21 to create magnetic field lines, thereby producing Joule heat inside the tank 1.

Note that, the frequency of the high-frequency AC power supply is higher than the frequency range of 50 Hz to 60 Hz used in home power supply, and a suitable frequency may be selected from a wide range of, for example, 250 Hz to 60 kHz, taking into account radio interference in the surrounding environment.

The heat-insulating wall 8 made of ceramic serves to protect the coil 21 from heat. One advantage of the superheated steam generator of the present embodiment is that it overcomes the drawback of a fixed coil that always heats the same area. This is achieved by the cart 22, which is kept moving to change the areas of generated heat, thereby heating a wide area inside the tank 1. Further, by moving the cart 22, the temperatures of the metal plates 11 and the beads 13 can be adjusted not to exceed their Curie points.

The heat-insulating wall 8 of the casing 2, which is made of ceramic in the present embodiment, may be made of other heat-insulating materials, for example, such as glass fiber.

Inside the tank 1, a temperature sensor (not shown) is provided that detects a predetermined temperature to operate a switch that is operating on a high-frequency current, so that a rise and fall of the temperature can be controlled. This allows a temperature to be gradually increased or decreased over a maintained level of high-frequency output, without accompanying an abrupt temperature increase, thereby improving the accuracy of temperature control over conventionally.

Further, in the superheated steam generator of the present embodiment, the cart 22 is equipped with a fan 24, so as to suitably release the heat generated inside the cart 22. Further, a spacing between the cart 22 and the heat-insulating wall 8 on one side of the cart 22 is used as a vent 26.

Through the vent 26, air can flow into the cart 22 in the direction of arrow to cool the coil 21.

The number of fans 24 may be suitably selected according to a state of generated heat from the coil 21. Further, means to cool the coil 21 is not just limited to air-cooling as described herein, and other means, such as water-cooling as described in connection with the BACKGROUND OF THE INVENTION section, may be suitably adopted.

According to the described configuration, the superheated steam generator of the present embodiment can continuously produce superheated steam of high temperature and high pressure from the superheated steam discharge pipe 5, with a temperature of about 450° C. or greater and in an amount sufficient to disinfect food products, under the conditions where the output power is 20 kw and the saturated steam is supplied from the steam supply pipe 3 at a rate of 200 Kg/h.

It should be noted that the temperature of the steam varies with the heat resistance of the heat source, and accordingly the temperature of 450° C. does not constitute an upper temperature limit of the steam. The superheated steam generator of the present invention can continuously produce superheated steam of higher temperature and higher pressure when the heat source is replaced with the one having a higher heat resistance.

In the case where the casing is ceramic and the magnetic plates used to divide the casing is metal as in the present embodiment, the magnetic plates should preferably be fixed on a shaft with beads held in place between the magnetic plates. In this way, the magnetic plates and the beads can be prepared simultaneously, which makes it easier to dispose the magnetic plates and the beads inside the tank.

It is equally effective to pack magnetic beads inside a magnetic mesh casing, because in this case the magnetic plates and the magnetic beads can be prepared simultaneously as a magnetic member.

[Second Embodiment]

Figure 3:
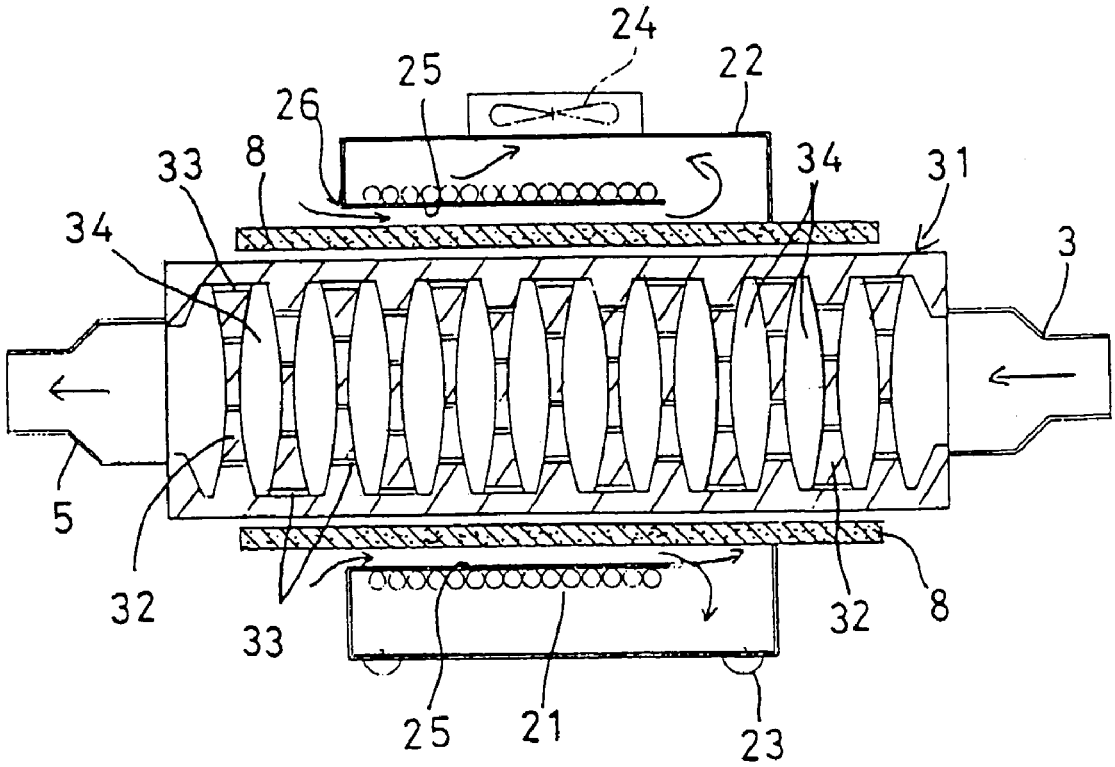
FIG. 3 is a cross sectional view showing a relevant part of a superheated steam generator according to another embodiment of the present invention.

Referring to FIG. 3, another embodiment of the superheated steam generator of the present invention is described below.

As shown in FIG. 3, the superheated steam generator of the present embodiment includes a superheating tank 31 and a magnetic member (metal plates 11), the superheating tank 31 being formed in one piece with the steam supply pipe 3 and the superheated steam discharge pipe 5 on the both ends of a casing 2 that is made of weakly magnetic stainless steel 403, 430.

The metal plates 11 and the casing 2 are made of the same kind of metal, and are formed in one piece, for example, by welding. This enables not only the metal plates 11 but also the casing 2 to be simultaneously heated by induction heating, thereby further improving the heat efficiency of the superheated steam generator.

The superheated steam generator of the present embodiment has the same configuration as that described in the First Embodiment, except that compartments 34 are provided side by side by providing a plurality of partitions 32 in a direction substantially orthogonal to the axis of the casing in the superheating tank 31, the partitions 32 being provided with a plurality of orifices 33 that connect the compartments 34 to one another.

In the superheated steam generator of the present embodiment, the orifices 33 are disposed in such a manner that their opening positions are staggered between adjacent partitions 32.

In this way, the steam that leaves the orifice 33 does not directly enter the orifice 33 of the adjacent partition 32 but instead collides with the wall of the partition 32 to create turbulence in the spacing. The steam therefore passes through the orifices 33 by undergoing a cycle of superheating and expansion before it reaches the discharge port. As a result, the efficiency of superheating can be further improved to continuously produce superheated steam of high temperature and high pressure with a temperature of 500° C. or greater.

According to the foregoing configuration, the superheated steam generator of the present embodiment can continuously produce superheated steam of high temperature and high pressure from the superheated steam discharge pipe 5, with a temperature of about 520° C. or greater and in an amount sufficient to disinfect food products, under the conditions where the output power is 20 kw and the saturated steam is supplied from the steam supply pipe 3 at a rate of 200 Kg/h, as in the First Embodiment.

It should be noted that the temperature of the steam varies with the heat resistance of the heat source, and accordingly the temperature of 450° C. does not constitute an upper temperature limit of the steam. The superheated steam generator of the present invention can continuously produce superheated steam of higher temperature and higher pressure when the heat source is replaced with the one having a higher heat resistance.

[Third Embodiment]

Figure 4:
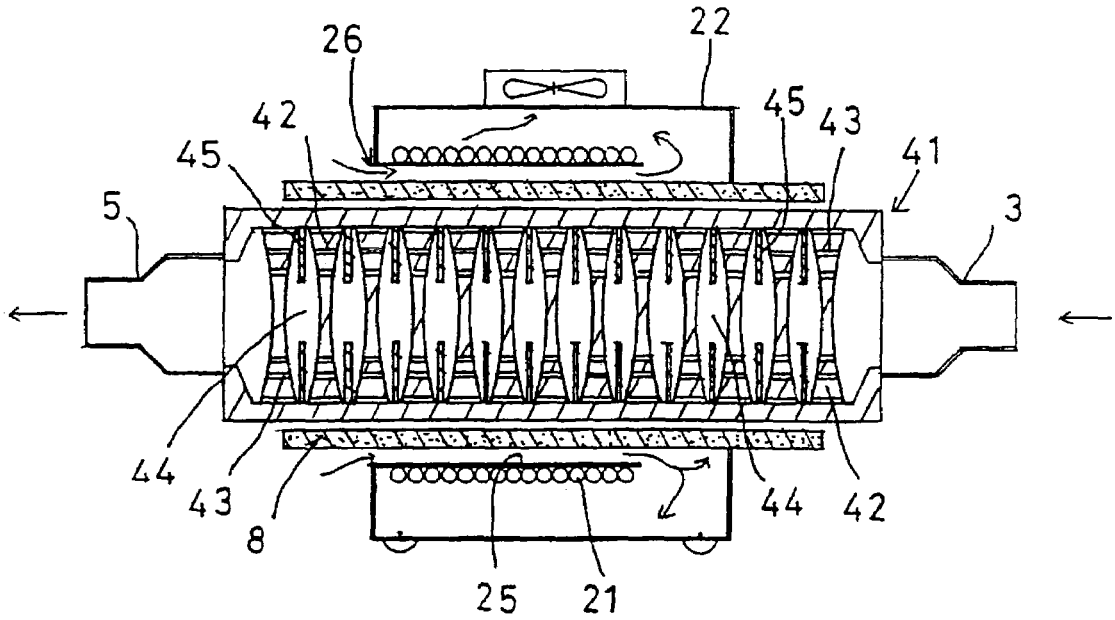
FIG. 4 is a cross sectional view showing a relevant part of a superheated steam generator according to yet another embodiment of the present invention.
Figure 5:
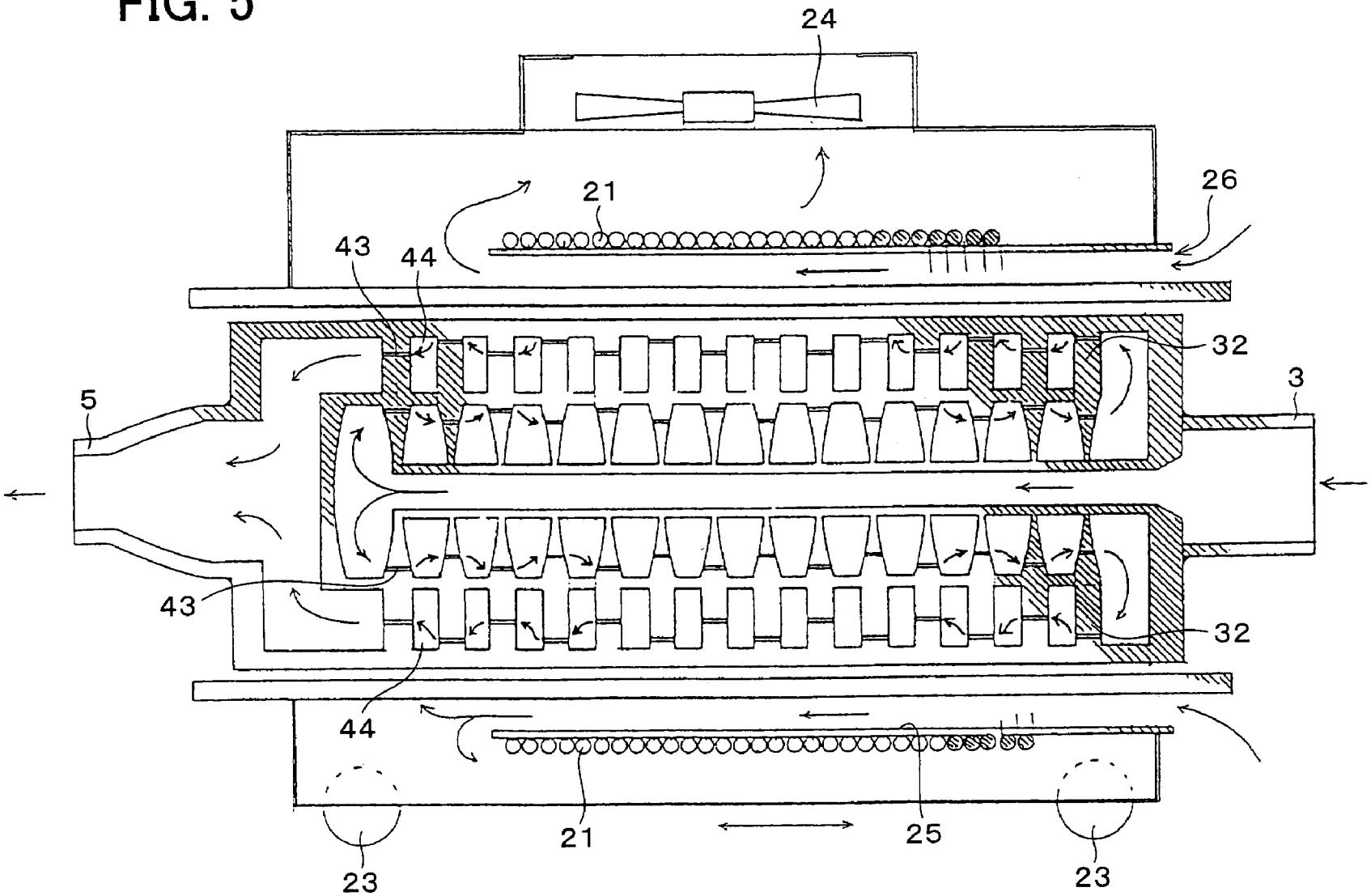
FIG. 5 is a cross sectional view showing a configuration of the superheated steam generator of the present invention.
Figure 6:
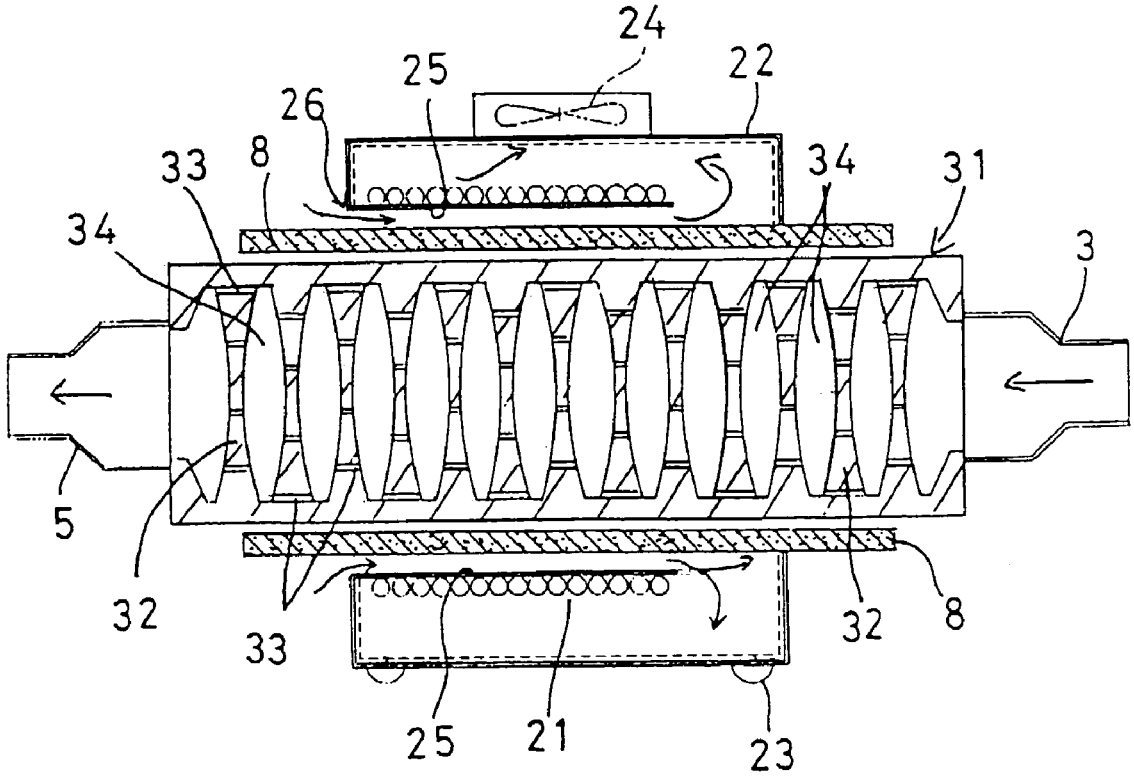
FIG. 6 is a cross sectional view showing one example of the superheated steam generator of FIG. 3, in which a coil is surrounded by a copper shield for protection against electromagnetic waves.

Referring to FIG. 4 through FIG. 6, yet another embodiment of the superheated steam generator of the present invention is described below.

As shown in FIG. 4, the superheated steam generator of the present embodiment further improves efficiency of superheating by causing the steam that leaves the orifice 12 of the metal plate 11 to collide with a collision plate.

As in the Second Embodiment, the superheated steam generator of the present embodiment includes a superheating tank and a magnetic member that are made of the same kind of metal and are formed in one piece, for example, by welding. This enables the superheating tank and the magnetic member inside the superheating tank to be simultaneously heated, thereby superheating the steam more efficiently.

The superheated steam generator of the present embodiment is also provided with compartments 44 that are disposed side by side by providing a plurality of partitions 42 in a direction substantially orthogonal to the axis of the casing in the superheating tank 41. A periphery portion of the partition 42 has a plurality of orifices 43 that connect the compartments 44 to one another.

The superheated steam generator of the present embodiment has the same configuration as those described in the foregoing embodiments, except that a thin ring plate (collision plate) 45 is welded to the partition 42 in one piece inside each compartment 44, the ring plate 45 being made of the same material as the partition 42.

The ring plate 45 is disposed such that its center is on the inner side of the nearest orifice 43 of the partition 42.

In this way, the steam that leaves the orifice 43 and enters the compartment 44 always hits the collision plate 45, upon which turbulence is created within the compartment 44. In the compartment 44, superheating of the steam is facilitated by a high temperature of the ring plate 45, and the steam is mixed therein. This is repeated as the steam moves from one compartment 44 to another through the orifices 43, thereby efficiently increasing the temperature of the steam by repeating the cycle of superheating and expansion every time the steam passes the compartment 44. As a result, superheated steam of sufficiently high temperature and pressure, with a temperature of 500° C. or greater, can be continuously produced.

Note that, the present embodiment described the case where the collision plate is in the form of a ring. However, the shape of the collision plate is not just limited thereto. Namely, the collision plate may have any plate form, so long as the steam leaving the orifice 43 hits the plate.

According to the foregoing configuration, the superheated steam generator of the present embodiment can continuously produce superheated steam of high temperature and high pressure from the superheated steam discharge pipe 5, with a temperature of about 500° C. or greater and in an amount sufficient to disinfect food products, under the conditions where the output power is 20 kw and the saturated steam is supplied from the steam supply pipe 3 at a rate of 200 Kg/h, as in the foregoing First and Second Embodiments.

The superheated steam generator of the present invention is not just limited to the configuration shown in FIG. 1, 3, or 4. For example, a configuration shown in FIG. 5 may be adopted.

The superheated steam generator shown in FIG. 5 is configured to more efficiently generate superheated steam of sufficiently high temperature and pressure, as described below.

In the superheated steam generator shown in FIG. 5, the steam supplied from the steam supply pipe 3 is first passed through a central portion of the tank 41 toward the superheated steam discharge pipe 5. The steam on the side of the superheated steam discharge pipe 5 of the tank 41 is then passed through a plurality of compartments 44 through orifices 43 back toward the steam supply pipe 3. The steam on the side of the steam supply pipe 3 is again passed through the compartments 44 through orifices 43 toward the superheated steam discharge pipe 5. By thus repeating the cycle of superheating and expansion, it is possible to continuously and more efficiently generate superheated steam of sufficiently high temperature and pressure with a temperature of 500° C. or greater.

By increasing the number of orifices 43 and compartments 44 that provide a passageway of the steam from those of the superheated steam generators shown in FIGS. 1, 3, and 4, it is possible to continuously and more efficiently generate superheated steam of sufficiently high temperature and pressure with a temperature of 500° C. or greater.

Further, as shown in FIG. 6, the superheated steam generator of the present invention may be provided with, for example, a copper casing (shown in dotted line in FIG. 6), so as to cover the coil 21 for protection against electromagnetic waves. By thus covering the coil 21 with a casing that is made of a material capable of shielding electromagnetic waves, adverse effects of electromagnetic wave on human body, which are caused by the electromagnetic wave generated by the coil 21 by electromagnetic induction, can be prevented.

It should be noted that the temperature of the steam varies with the heat resistance of the heat source, and accordingly the temperature of 450° C. does not constitute an upper temperature limit of the steam. The superheated steam generator of the present invention can continuously produce superheated steam of higher temperature and higher pressure when the heat source is replaced with the one having a higher heat resistance.

The technical problems associated with conventional superheated steam generators are solved by the superheated steam generator of the present invention by means of:

(1) providing a magnetic body inside the superheating tank; and (2) passing the steam in contact with the magnetic body.

The magnetic body (may be referred to as "magnetic member" hereinafter) inside the superheating tank of an electromagnetic induction type exerts magnetism on the magnetic field lines that are generated by feeding power from the high-frequency AC power supply. This reduces the magnitude of eddy currents by a small amount. The eddy currents generate Joule heat that also heats the magnetic member inside the tank. Thus, by reducing the eddy currents, the temperature inside the tank increases more gradually.

In its passage through the tank, the steam is brought into contact with the magnetic member that is being heated. The steam is converted to superheated steam by being superheated and moves toward the discharge end of the tank by gradually expanding. The magnetic member is still in a high temperature state when the power supply to the coil is cut after a temperature increase is detected in the tank, and the temperature inside the tank decreases as the magnetic member cools down. Thus, it takes some time for the temperature inside the tank to decrease. That is, not only temperature increase but temperature decrease is also gradual without accompanying any abrupt change.

The temperature increase and temperature decrease can be made even slower by using a weakly magnetic material for the magnetic member.

The temperature of the superheated steam is related to not only the magnitude of the induced current but also the amount of supplied steam. That is, given the same magnitude of induced current, the temperature of the superheated steam can be controlled in a low temperature range by increasing the amount of supplied steam, and conversely in a high temperature range by decreasing the amount of supplied steam. Alternatively, the temperature of the superheated steam may be controlled by adjusting the pressure at the discharge end under constant flow rate.

The superheating tank may be made of metal or ceramic.

For example, when using a metal superheating tank, the magnetic plates and the superheating tank should preferably be formed in one piece, for example, by welding. In this way, not only the magnetic plates but also the superheating tank can be heated by induction heating, thereby continuously and more efficiently producing superheated steam of high temperature and high pressure with a temperature of 500° C. or greater.

Examples of the magnetic member include strongly magnetic metals such as iron; weakly magnetic metals such as stainless steel 430, 403, 304, nickel, and titanium; and carbon ceramic.

For smooth passage of the steam inside the tank, the magnetic member should preferably be realized by beads, a mesh, or a plate with a plurality of orifices. The beads may be beads or other small objects of various forms. The beads may optionally have orifices. The magnetic member, when realized in these forms, can be conveniently provided because the magnetic member only needs to be packed or loaded in the tank.

Further, the magnetic member may be realized by a combination of magnetic beads and a plurality of magnetic plates with orifices, by packing the magnetic beads between the magnetic plates that are spaced along the pathway of the steam. In this case, the steam moves along the surface of the magnetic beads, thereby increasing the area of contact and improving heat efficiency.

One or more orifices may be provided, depending on the size of the tank or the amount of steam passed.

The beads can be stably held in place when the magnetic plates have concave faces on the both sides. Further, with the concave faces, the steam can be superheated more efficiently because the thinner portion of the magnetic plates near the center is more readily heated than the thicker portion.

In the superheated steam generator, the superheating tank and the magnetic body may be provided in one piece, for example, by welding. In this case, heat efficiency can be further improved by providing compartments side by side inside the tank by disposing a plurality of partitions in a direction substantially orthogonal to the tank axis, and by providing the partitions with orifices for connecting one compartment to another. In this way, the steam can expand efficiently as it passes through the series of compartments one after another, thus allowing the superheated steam to be forced out of the discharge end.

Here, the orifices may be provided in such a manner that their opening positions are staggered between adjacent partitions. In this case, the steam from each compartment always hits the wall of the adjacent partition to create turbulence in the spacing before the steam enters the next orifice. As a result, superheated steam can be generated more efficiently.

Further, the superheating tank and the magnetic body may be formed in one piece, for example, by welding, so that compartments are provided side by side inside the tank by disposing a plurality of partitions in a direction substantially orthogonal to the tank axis, the partitions being provided with a plurality of orifices for connecting one compartment to another, and collision plates, made of a magnetic material, are disposed between the orifices.

In this case, the steam that leaves the orifice hits the collision plate that has been heated to a high temperature. Simultaneously, the steam creates turbulence in the compartment. Here, the collision plate, being thinner than the partition, has a higher temperature than the partition. Thus, the steam is heated to a high temperature and mixed in each compartment before it moves to the next compartment through the orifice. This is repeated as the steam moves from one compartment to another through the orifices, thereby continuously generating superheated steam with improved efficiency by repeating the cycle of superheating and expansion every time the steam passes the compartment.

Here, the opening positions of the orifices of adjacent partitions may be in eclipse or staggered, so long as the steam from the orifice is able to hit the collision plate.

The steam can be superheated even more efficiently when the collision plates are heated to a higher temperature. This can be achieved by providing orifices on a periphery portion of the partitions and by inserting ring-shaped collision plates between the partitions. In such a one-piece construction, one or more orifices may be provided, depending on the size of the tank or the amount of steam passed.

Preferably, the coil connected to the high-frequency AC power supply is moved back and forth along the superheating tank. In this way, an area of generated Joule heat in the tank can be moved. This prevents the magnetic member from being overheated inside the tank and thereby prevents loss of magnetism of the magnetic member due to overheating. As a result, stable temperature control can be carried out.

With the superheated steam generator of the present invention, the temperature inside the tank can be increased and decreased gradually. This makes it easier to control the temperature by ON/OFF of the power supply, so that accurate temperature control can be carried out. As a result, a sufficient amount of superheated steam can be obtained with suitable temperatures for different uses.

It is preferable that the magnetic member be provided as partitions that divide the inner spacing of the tank into a plurality of compartments, the partitions being provided with orifices that connect adjacent compartments to each other.

In this case, the steam is delivered to the discharge end of the tank through the orifices of the partitions inside the tank. Here, the partitions, which are magnetic, are heated to a high temperature by the Joule heat, and therefore are able to continuously and more efficiently generate superheated steam of high temperature and high pressure with a temperature of 500° C. or greater.

It is preferable that the superheating tank be made of metal, and the magnetic member be provided in one piece with the superheating tank.

In this way, not only the magnetic member but also the superheating tank can be heated to a high temperature by induction heating, thus continuously generating steam of high pressure and high temperature with improved efficiency.

It is preferable that the orifices be provided in a staggered fashion between adjacent partitions.

In this way, the steam leaves the orifice of the partition does not directly flow into the orifice of the next partition. Instead, the steam hits the partition and expands in the compartment by being superheated therein before entering the orifice of the next partition. As a result, superheated steam of high temperature and high pressure, with a temperature of 500° C. or greater, can be generated continuously and more efficiently.

It is preferable that the collision plates be provided between adjacent partitions, so that the steam flowing out of the orifice hits the collision plate.

In this way, the steam that leaves the orifice of the partition does not directly flow into the orifice of the next partition. Instead, the steam hits the collision plate and is superheated in the compartment before entering the orifice of the next partition. As a result, superheated steam of high temperature and high pressure, with a temperature of 500° C. or greater, can be produced continuously and more efficiently.

It should be noted that the present invention is not just limited to the examples of the foregoing embodiments wherein the superheated steam generator is used for the disinfections of food products in a food processor. For example, the present invention is also applicable to various types of heat treatment devices.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A superheated steam generator, comprising:

a conduit, which provides a passageway of generated steam;

a metallic superheating tank, which is part of the conduit midway through the conduit; and a coil, which is disposed around the superheating tank, wherein the generated steam inside the superheating tank is heated by electromagnetically induced heat produced by applying a voltage to the coil, said superheated steam generator further comprising:

a magnetic body, disposed inside the superheating tank, which is in contact with the steam in the passage of the steam, the magnetic body being formed in one piece with the superheating tank by welding.

2. The superheated steam generator as set forth in claim 1, wherein the magnetic body is in the form of partitions that divide an inner spacing of the superheating tank into a plurality of compartments, each of the partitions having an orifice that connects the compartments to one another.

3. The superheated steam generator as set forth in claim 2, wherein the orifices are disposed in a staggered fashion between adjacent ones of the partitions.

4. The superheated steam generator as set forth in claim 2, wherein a collision plate is interposed between the partitions so that the steam flowing out of the orifice hits the collision plate.

5. The superheated steam generator as set forth in claim 1, wherein the magnetic body is a mesh, a bead, or a plate that has an orifice.

6. The superheated steam generator as set forth in claim 5, wherein the beads comprise spheres with or without an orifice.

7. The superheated steam generator as set forth in claim 1, wherein the magnetic body includes a magnetic mesh casing, and magnetic beads that are packed inside the magnetic mesh casing.

8. The superheated steam generator as set forth in claim 1, wherein the magnetic body is a weakly magnetic material.

9. The superheated steam generator as set forth in claim 1, wherein the coil is connected to a high-frequency AC power supply, and is movable along the superheating tank.

10. The superheated steam generator as set forth in claim 2, wherein the partitions each have concave faces.

11. The superheated steam generator as set forth in claim 2, further comprising a collision plate, made of a magnetic material, between the partitions.

12. The superheated steam generator as set forth in claim 2, further comprising magnetic beads that are packed between the partitions.

13. The superheated steam generator as set forth in claim 1, wherein the superheating tank and the magnetic body are made of metal.

14. A superheated steam generator, comprising:

a conduit, which provides a passageway of generated steam a superheating tank, which is part of the conduit midway through the conduit; and a coil, which is disposed around the superheating tank, wherein the generated steam inside the superheating tank is heated by electromagnetically induced heat produced by applying a voltage to the coil, said superheated steam generator further comprising:

a magnetic body, disposed inside the superheating tank, which is in contact with the steam in the passage of the steam;

wherein the magnetic body comprises a plurality of magnetic plates, each having an orifice, that are spaced apart from one another in a direction of travel of the steam, and magnetic beads that are packed between the magnetic plates.

15. The superheated steam generator as set forth in claim 14, wherein the magnetic plates each have concave faces.

16. The superheated steam generator as set forth in claim 14, wherein the magnetic plates are fixed on a shaft that penetrates through the magnetic plates, with the magnetic beads being held in place between the magnetic plates.

17. A superheated steam generator, comprising:

a conduit, which provides a passageway of generated steam a superheating tank, which is part of the conduit midway through the conduit; and a coil, which is disposed around the superheating tank, wherein the generated steam inside the superheating tank is heated by electromagnetically induced heat produced by applying a voltage to the coil, said superheated steam generator further comprising:

a magnetic body, disposed inside the superheating tank, which is in contact with the steam in the passage of the steam;

wherein the superheating tank and the magnetic body are formed in one piece, and inside the superheating tank are provided compartments that are provided side by side by disposing a plurality of partitions in a direction substantially orthogonal to an axis of the superheating tank, the partitions having a plurality of orifices that connect the compartments to one another.

18. The superheated steam generator as set forth in claim 17, wherein the orifices of the partitions are positioned such that openings of the orifices are positioned in a staggered fashion between adjacent ones of the partitions.

19. A superheated steam generator, comprising:

a conduit, which provides a passageway of generated steam a superheating tank, which is part of the conduit midway through the conduit; and a coil, which is disposed around the superheating tank, wherein the generated steam inside the superheating tank is heated by electromagnetically induced heat produced by applying a voltage to the coil, said superheated steam generator further comprising:

a magnetic body, disposed inside the superheating tank, which is in contact with the steam in the passage of the steam;

wherein the superheating tank and the magnetic body are formed in one piece, and inside the superheating tank are provided compartments that are provided side by side by disposing a plurality of partitions in a direction substantially orthogonal to an axis of the superheating tank, the partitions having a plurality of orifices that connect the compartments to one another, and between the orifices is interposed a collision plate that is made of a magnetic material.

20. The superheated steam generator as set forth in claim 19, wherein the orifices are disposed at a peripheral portion of the partitions, and the collision plate is in the form of a ring so as to provide an opening through the collision plate.

21. A superheated steam generator for heating steam by electromagnetically induced heat, comprising:

a plurality of magnetic plates, each having an orifice, that are spaced apart from one another in a direction of travel of steam, the magnetic plates each having a thickness thinning toward the center.

22. The superheated steam generator as set forth in claim 21, wherein the orifices of the magnetic plates are positioned in a staggered fashion between adjacent ones of the magnetic plates.

23. The superheated steam generator as set forth in claim 21, further comprising a collision plate, made of a magnetic material, between the magnetic plates.

24. The superheated steam generator as set forth in claim 21, wherein the magnetic plates each have concave faces.

25. The superheated steam generator as set forth in claim 21, wherein the magnetic plates are weakly magnetic.

* * * * *

UNITED STATES PATENT AND TRADEMARK OFFICE
Certificate

Patent No. 7,115,845 B2 Patented: October 3, 2006

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Masami Nomura, Osaka, (JP); and Masaaki Nomura, Higashiosaka, (JP).

Signed and Sealed this Twenty-ninth Day of May 2007.

PHILIP H. LEUNG
*Acting Supervisory Patent Examiner*
Art Unit 3742